US007296236B2

(12) United States Patent
King

(10) Patent No.: US 7,296,236 B2
(45) Date of Patent: Nov. 13, 2007

(54) APPLIANCE CONTROL IDENTIFICATION SYSTEM EMPLOYING USER INTERFACE SCAN MATRIX

(75) Inventor: Jonathan D. King, Lexington, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 955 days.

(21) Appl. No.: 10/186,922

(22) Filed: Jul. 2, 2002

(65) Prior Publication Data

US 2004/0004635 A1 Jan. 8, 2004

(51) Int. Cl.
*G06F 3/048* (2006.01)
*G06F 3/047* (2006.01)

(52) U.S. Cl. ..... 715/746; 700/95; 134/58; 68/12.27

(58) Field of Classification Search ..... 8/159; 340/825.33; 700/17, 83, 95; 134/18; 318/102; 715/764
See application file for complete search history.

(56) References Cited

U.S. PATENT DOCUMENTS 3,622,990 A 11/1971 Lerch
3,844,299 A 10/1974 Athey et al.
3,893,082 A 7/1975 Ryder
3,911,943 A 10/1975 Athey et al.
3,947,665 A 3/1976 Hundley
3,949,782 A 4/1976 Athey et al.
4,275,464 A 6/1981 Schmidt
4,279,021 A 7/1981 See et al.
4,320,386 A 3/1982 Harris
4,400,699 A * 8/1983 Glasmacher ..... 340/825.22
4,431,988 A 2/1984 Molusis et al.
4,500,933 A 2/1985 Chan
4,502,040 A 2/1985 Castel
4,631,700 A 12/1986 Lapeyre
4,703,306 A * 10/1987 Barritt ..... 340/310.18
4,831,226 A 5/1989 Robeson et al.
4,841,125 A 6/1989 Edamura
4,848,381 A 7/1989 Livingston et al.
4,920,948 A 5/1990 Koether et al.
4,924,520 A 5/1990 Kolbert
4,977,394 A 12/1990 Manson et al.
5,107,088 A 4/1992 Aoki
5,291,667 A 3/1994 Joslin et al.
5,306,995 A 4/1994 Payne et al.
5,347,727 A 9/1994 Kim
5,349,344 A 9/1994 Head
5,412,291 A * 5/1995 Payne et al. ..... 318/102
5,450,078 A 9/1995 Silva et al.
5,524,362 A 6/1996 Quandt et al.
5,572,573 A 11/1996 Sylvan et al.

(Continued)

*Primary Examiner*—Weilun Lo
*Assistant Examiner*—Steven B. Theriault
(74) *Attorney, Agent, or Firm*—Michael D. Lafrenz; Kirk Goodwin

(57) ABSTRACT

A universal controller is employed in a domestic appliance including a user interface. In order to determine the particular user interface utilized and, correspondingly, the available cycles, features and options of the appliance, a scan of a keypad matrix associated with the user interface is performed to determine the presence and/or absence of shorts used to reflect the existence of permanently closed keys of the matrix. In accordance with the invention, the shorts can be indicated individually, in sequence and/or in combination in order to indicate to the controller which firmware to execute for a particular user interface.

14 Claims, 4 Drawing Sheets

U.S. PATENT DOCUMENTS 5,619,614 A * 4/1997 Payne et al. ..... 706/1
5,647,231 A 7/1997 Payne et al.
5,651,193 A 7/1997 Rhodes et al.
5,818,428 A * 10/1998 Eisenbrandt et al. ..... 345/173
5,856,795 A * 1/1999 Arnold et al. ..... 341/26
5,967,021 A * 10/1999 Yung ..... 99/327
5,971,270 A 10/1999 Barna
6,073,201 A 6/2000 Jolley et al.
6,138,182 A 10/2000 Hennessy et al.
6,275,922 B1 8/2001 Bertsch
6,425,156 B1 * 7/2002 Knopp et al. ..... 8/159
6,515,653 B2 * 2/2003 Kao et al. ..... 345/168
6,549,866 B1 * 4/2003 Bhatnagar ..... 702/86
6,591,151 B1 7/2003 Knopp et al.
6,621,484 B1 * 9/2003 Yee ..... 345/168
6,648,981 B2 * 11/2003 McIntyre et al. ..... 134/18
6,739,145 B2 * 5/2004 Bhatnagar ..... 62/127
2002/0116959 A1 * 8/2002 Ohta et al. ..... 68/12.27
2003/0229404 A1 * 12/2003 Howard et al. ..... 700/17

* cited by examiner

APPLIANCE CONTROL IDENTIFICATION SYSTEM EMPLOYING USER INTERFACE SCAN MATRIX

BACKGROUND OF THE INVENTION

1. Field of the Invention

The present invention pertains to the art of appliances and, more particularly, to an arrangement for identifying an appliance model through a user interface by employing a scan matrix system.

2. Discussion of the Prior Art

In order to provide a product line which will appeal to a wide spectrum of consumers, product manufacturers will generally produce various product models. In the field of appliances, model differentiation is often concerned with adding or subtracting certain features, such as display aspects, available cycles and potential options. Depending on the available features, the controls for different appliance models will be varied. That is, each appliance will have a user interface which is designed based, at least in part, on the specific features incorporated into a given appliance model.

Based on the different cycles, options and other features between certain models, the electronic controllers employed in the appliances need to perform different functions. To this end, there must be either a distinct controller for each user interface employed or a way must be provided to signify to the controller what particular user interface and, correspondingly, what model features exist, in order to enable the appliance to operate properly. Obviously, providing distinct controllers can increase overall manufacturing costs significantly. For at least this reason, it would be preferential to provide a generally universal controller including a control board which can be signaled to identify the specific model in which the controller is used and the particular user interface connected thereto.

With this desired result in mind, it is considered possible to employ a latter programming step for each controller prior to installing the controller in a given appliance unit. That is, the controller can be preprogrammed so as to be usable in a wide range of appliance models. However, after it is known which model a given controller will be used, a final programming step is undertaken to correlate the controller with the specified model. In another alternative, a final programming operation can be performed after the controller is completely installed in the appliance. In any case, it is considered desirable to provide a system which will enable a universal appliance controller to be matched with a given appliance model in a cost efficient and overall effective manner.

SUMMARY OF THE INVENTION

The present invention is generally directed to identifying which version of a user interface is attached to an appliance controller in order to enable a single controller to be effectively employed in various appliance models. In accordance with the most preferred form of the invention, shorts are used to signal the controller of the identity of a particular user interface. More specifically, multiple shorts, which include the use of substantially zero-ohm jumpers or other resistors, and other components that could be used to simulate permanently closed keys, are used to indicate to the controller which firmware to execute.

With this arrangement, the controller executes a scan matrix upon initial power-up. The presence or absence of a shorted keypad in an overall keypad scan matrix functions to signal to the controller the identity of the particular user interface employed. Therefore, either a high or low logic level is signaled to the controller depending on the presence or absence of a short in the scan matrix. The number, sequence and combination of shorts signaled in the scan matrix is thereby used to indicate to the controller or microprocessor which firmware to execute in order to properly handle user key selections, LED indications, modes of operation including different cycle, demo and option modes, and the like. The shorts are provided, in accordance with the most preferred form of the invention, in unused sections of the overall keypad matrix.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
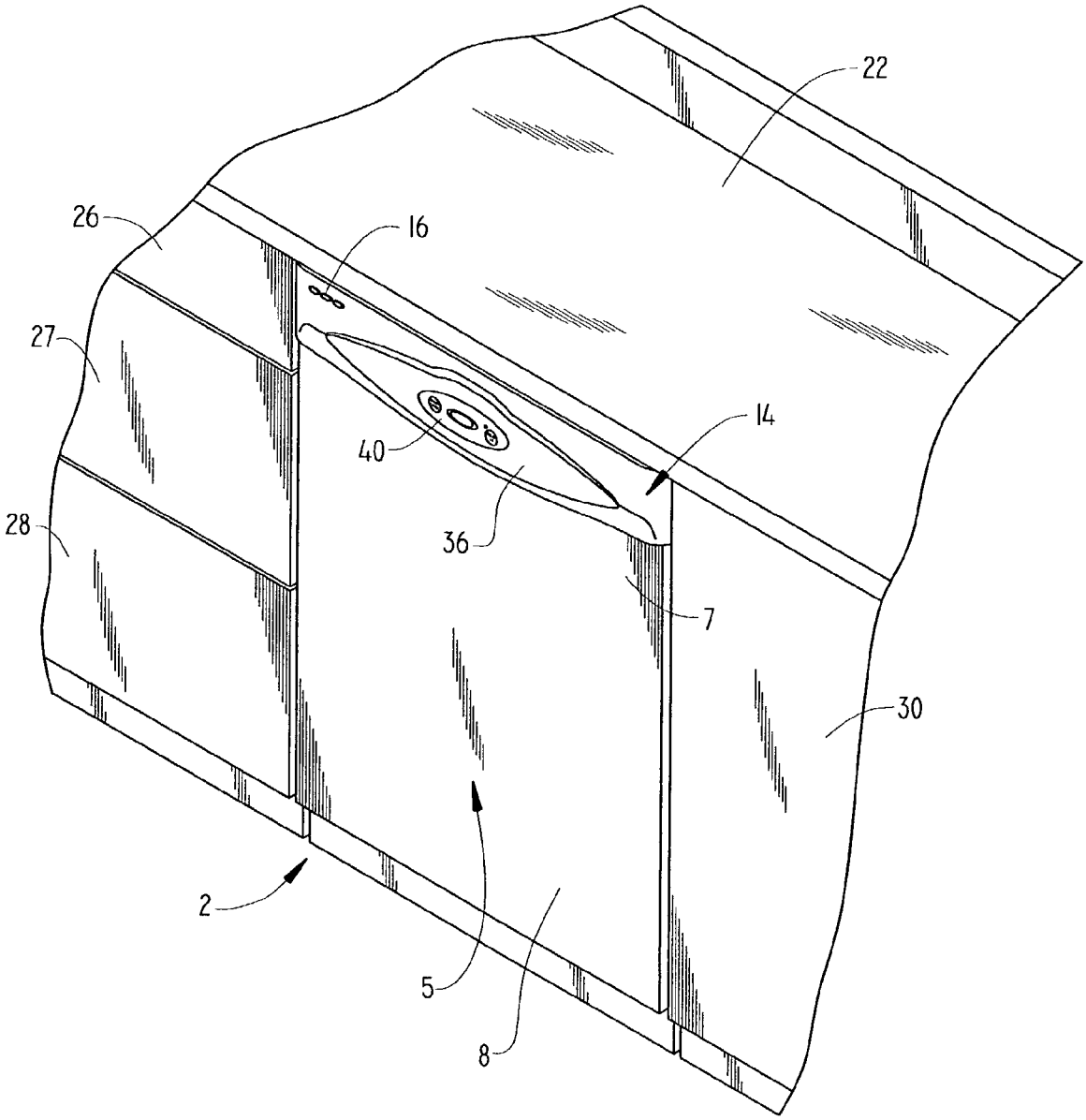
FIG. 1 is a perspective view of a domestic dishwasher incorporating the appliance control identification system of the invention.
Figure 2:
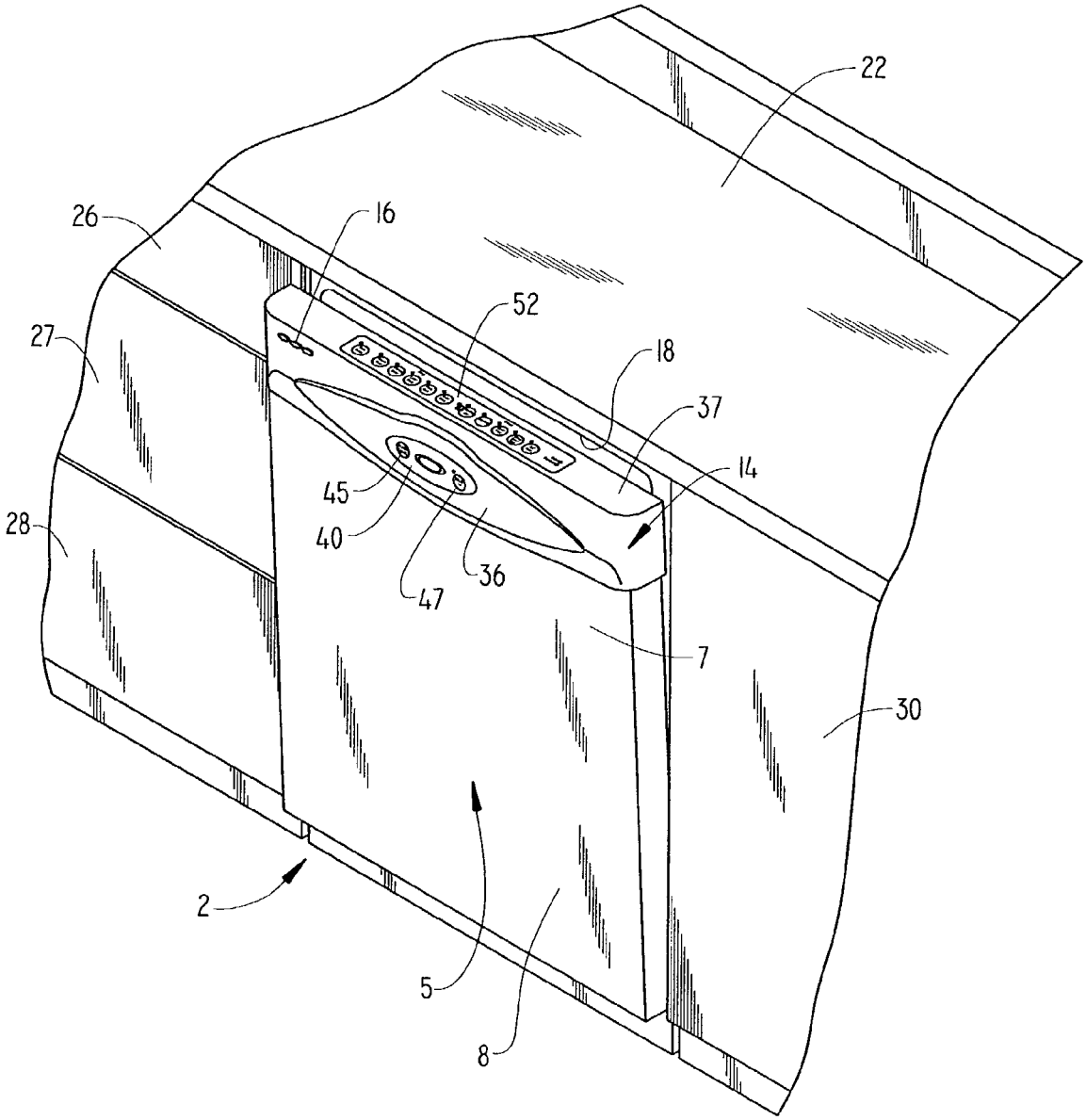
FIG. 2 is a perspective view of the dishwasher of claim 1, with a door of the dishwasher being shown slightly open to expose a control panel section of the dishwasher.

With initial reference to FIGS. 1 and 2, the present invention will be described in detail with reference to a dishwasher which is generally indicated at 2. As shown, dishwasher 2 includes a door 5 having an upper portion 7 and a lower portion 8. Provided at upper portion 7 is a control panel 14 having various control elements as will be detailed more fully below. Also provided at upper portion 7 is a plurality of vent openings 16. In a manner known in the art, door 5 is pivotally mounted at lower portion 8 for movement relative to and for closing off a washing tub 18. In addition, dishwasher 2 is shown positioned below a countertop 22 within a domestic kitchen. As such, shown on one side of dishwasher 2 is a plurality of vertically spaced drawers 26-28 and, on the other side of dishwasher 2, a cabinet 30.

Figure 3:
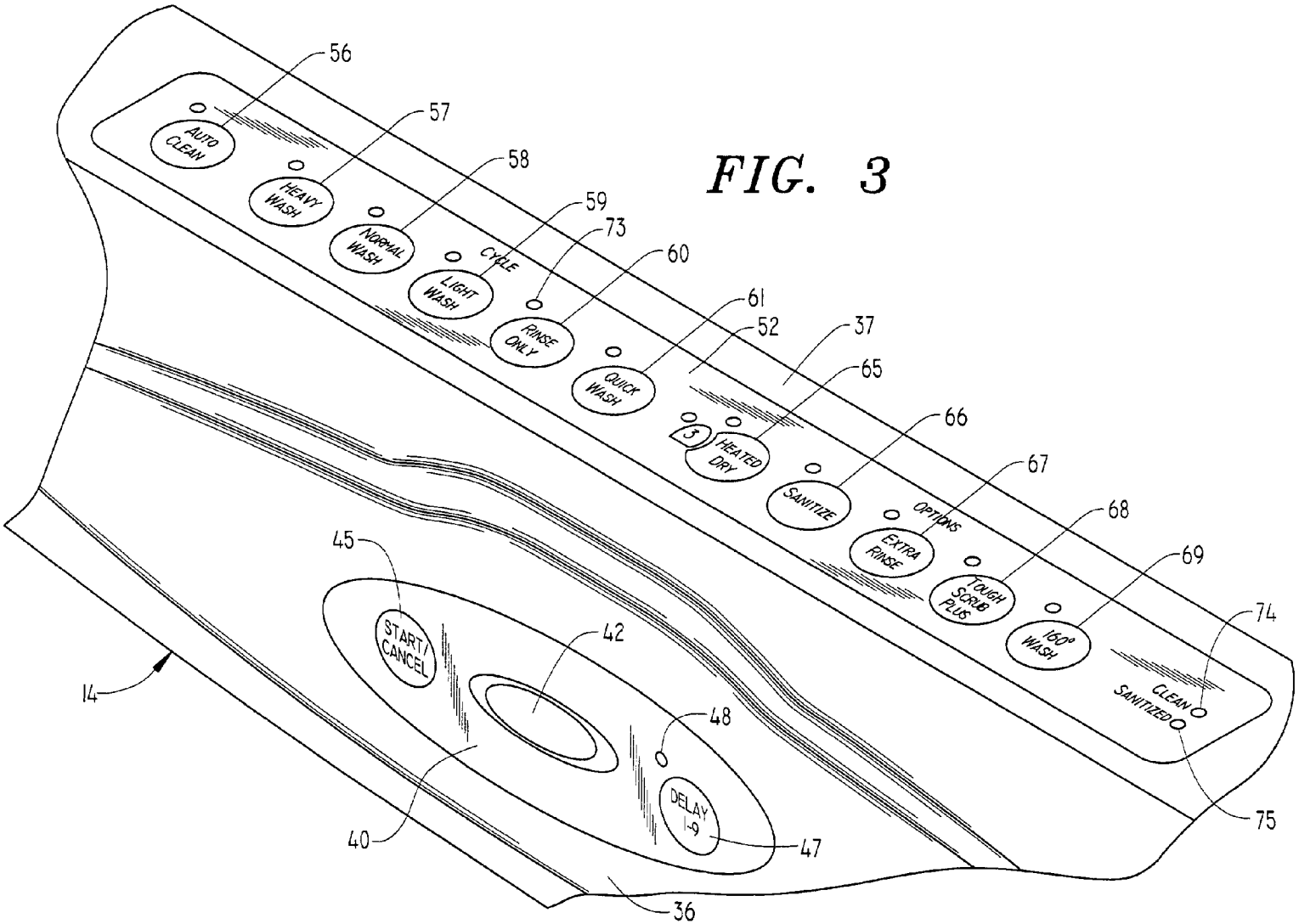
FIG. 3 is an enlarged view of the control panel and user interface incorporated in the dishwasher of FIGS. 1 and 2.

Reference will now be made to FIG. 3 in describing in further detail the various control elements employed on control panel 14 in accordance with a preferred embodiment of the invention. As illustrated, control panel 14 includes a front panel portion 36 and an upper panel portion 37. Within the confines of front panel portion 36 is defined a control section 40 including a display 42, a start/stop button 45 and a delay programming button 47. As depicted, an LED indicator 48 is provided to indicate when a delay cleaning operation is selected.

Control panel 14 also includes a control section 52 provided on upper panel portion 37. In the embodiment shown, control section 52 includes an auto clean, heavy wash, normal wash, light wash, rinse only and quick wash cycle selection buttons 56-61. Additional options are preferably provided, with these options being available through one or more of heated dry, sanitize, extra rinse, tough scrub plus and 160° F. wash buttons 65-69. Each of cycle and option buttons 56-61 and 65-69 is shown to have an associated LED indicator 73. In addition, separate clean and sanitized LED indicators 74 and 75 are also provided. At this point, it should be recognized that the overall configuration of control panel 14 as described above is exemplary in nature and that the available cycles, options and layout of the controls can be readily varied without departing from the invention.

Actually, the present invention is particularly directed to automatically determining the actual cycles, options and layout of the controls in order to enable a controller or microprocessor 90 (see FIG. 4), which is preprogrammed for use with various control panels and user interfaces, to be used across various model lines of the same type of appliance. That is, in the exemplary control panel 14 presented, control sections 40 and 52 collectively define a user interface. The exact configuration of the user interface will vary between different dishwasher models. However, universal controller 90 can be used for each of the models by identifying the particular or predetermined user interface employed in the manner set forth below.

Figure 4:
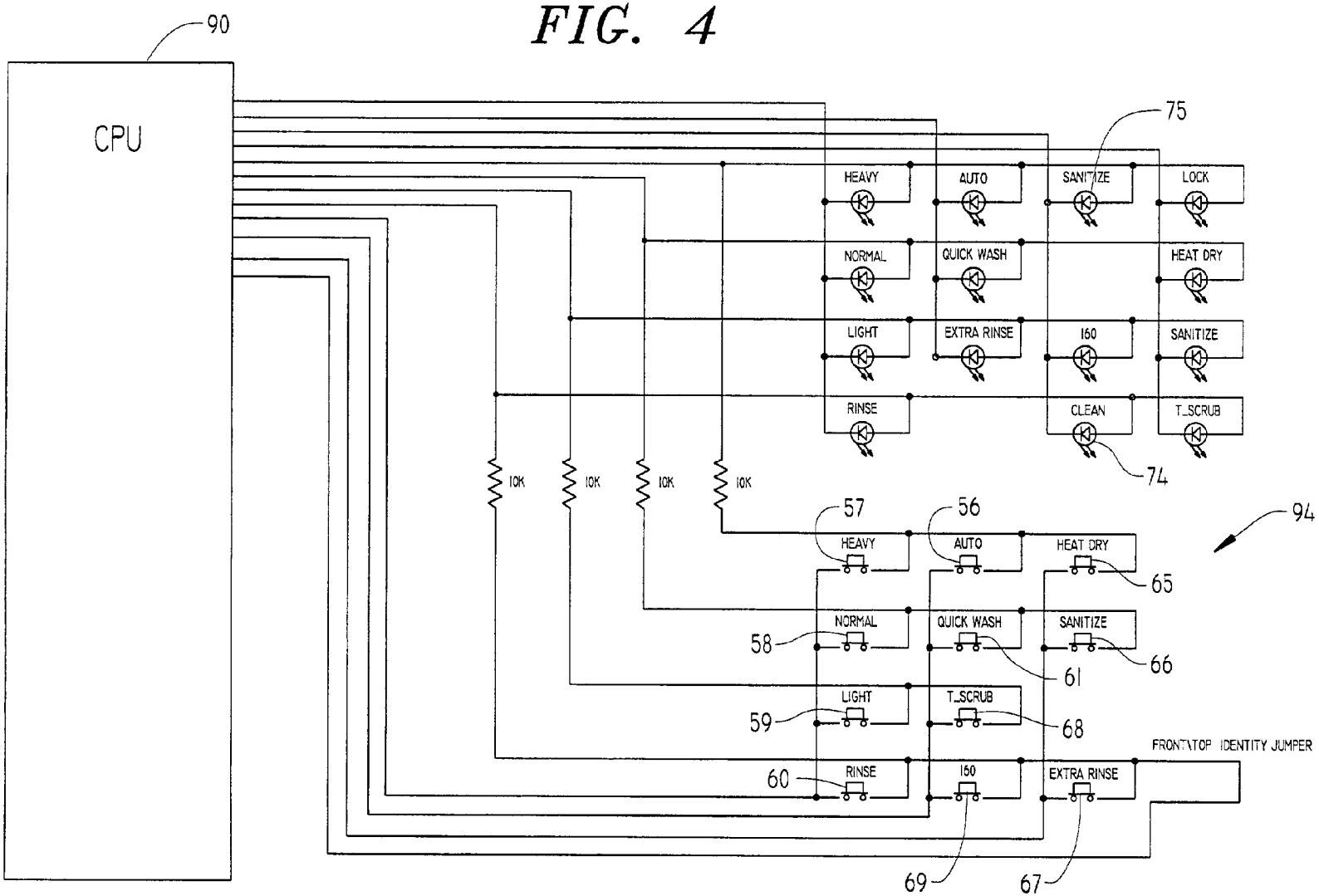
FIG. 4 is a schematic view of a keypad matrix and controller employed for the dishwasher of FIGS. 1-3.

As shown in FIG. 4, a particular user interface selected based on the desired cycles, options and features of dishwasher 2 results in a corresponding keypad matrix 94. In general, keypad matrix 94 corresponds directly to that disclosed above for control section 52. Keypad matrix 94 is therefore connected to controller 90 and it becomes necessary to determine the parameters of the user interface. To this end, a scan is made of keypad matrix 94, preferably during initial power-up following appliance assembly. In accordance with the most preferred embodiment of the invention, this scanning operation signals either the presence or absence (high or low logic levels) of shorts in keypad matrix 94. At this point, it is important to note that a "short" in accordance with the present invention can take various forms including an overall shorted keypad, the use of a zero-ohm jumper or other resistor or component that would simulate one or more permanently closed keys within keypad matrix 94. The shorts, which can be sensed individually, in combination such that only a predetermined group of shorts establishes a feature or parameter of the particular appliance, and/or as a specific sequence of shorts, are used by controller 90 to identify the proper set of software or firmware to execute.

In the exemplary embodiment shown, the illustrated short indicates that the functions of control section 52 are available. Correspondingly, controller 90 will operate to execute the necessary code to properly use the countdown display feature. In a directly analogous manner, the initial keypad matrix scan will identify the overall interface employed, thereby enabling the proper key presses, LED indications, demo modes, and the like to be performed. In this way, the present invention enables a particular version of a user interface attached to an appliance controller to be readily identified in a convenient, reliable and cost effective manner, thereby allowing a single controller to be effectively employed in various appliance models.

Although described with reference to a preferred embodiment of the invention, it should be readily understood that various changes and/or modifications can be made to the invention without departing from the spirit thereof. For instance, although the invention has been described with particular reference to a dishwasher, it should be apparent that the invention is also applicable to various domestic appliances, including clothes washing machines, clothes dryers, refrigerators, and cooking appliances. In addition, it should be noted that various appliance models can incorporate certain common operations such that the keypad matrix scan need only identify variable operations. In any event, the invention is only intended to be limited by the scope of the following claims.

I claim:

1. A method of identifying a select user interface connected to a universal controller for a domestic appliance comprising:

assembling the domestic appliance with the controller and the select user interface having an associated keypad matrix;

initiating a keypad matrix scan;

signaling shorts sensed during the keypad matrix scan to the controller; and establishing a set of pre-stored operational firmware, corresponding to the select user interface, to be executed by the controller of the domestic appliance based on the shorts signaled in the keypad matrix.

2. The method of claim 1, further comprising: signaling a short when a permanently closed key is encountered during the keypad matrix scan.

3. The method of claim 1, wherein the set of pre-stored operational firmware is established based on combinations of shorts sensed during the keypad matrix scan.

4. The method of claim 1, wherein the set of pre-stored operational firmware is established based on one or more sequences of shorts sensed during the keypad matrix scan.

5. The method of claim 1, further comprising: in addition to establishing the set of pre-stored operational firmware based on the shorts signaled in the keypad matrix, further establishing the set of pre-stored operational firmware due to an absence of a short in the keypad matrix scan.

6. A method of operating of a domestic appliance comprising:

assembling the domestic appliance with a universally programmed controller and a user interface selected from a plurality of user interfaces;

performing a scan of a keypad matrix for the appliance;

signaling a presence or absence of shorts during the keypad matrix scan to the controller;

identifying the user interface based on signals received during the scan of the keypad matrix; and executing firmware during operation of the domestic appliance based on the identified user interface.

7. The method of claim 6, further comprising: signaling a short when a permanently closed key of the user interface is encountered during the keypad matrix scan.

8. The method of claim 6, wherein the user interface is identified based on combinations of shorts sensed during the keypad matrix scan.

9. The method of claim 6, wherein the user interface is identified based on one or more sequences of shorts sensed during the keypad matrix scan.

10. A domestic appliance comprising:

a control panel including a predetermined user interface having a plurality of control elements for selecting a desired one of a plurality of available operating cycles for the appliance, said plurality of control elements defining a keypad matrix corresponding to the predetermined user interface;

a controller, linked to the control panel, for establishing the one of the plurality of desired operating cycles, said controller being configured to operate with a plurality of distinct user interfaces; and means for performing a scan of and signaling shorts in the keypad matrix in order to automatically identify the predetermined user interface of the control panel.

11. The domestic appliance according to claim 10, wherein the performing and signaling means indicates a short when a permanently closed key of a respective one of the plurality of control elements is encountered during the keypad matrix scan.

12. The domestic appliance according to claim 10, wherein the performing and signaling means determines combinations of shorts during the scan of the keypad matrix in order to identify the predetermined user interface.

13. The domestic appliance according to claim 10, wherein the performing and signaling means determines sequences of shorts during the scan of the keypad matrix in order to identify the predetermined user interface.

14. The domestic appliance according to claim 10, wherein the domestic appliance constitutes a dishwasher.

* * * * *